3/24/87 XR 4,652,729

United States Patent [19]

Kubota et al.

[11] Patent Number: 4,652,729

[45] Date of Patent: Mar. 24, 1987

[54] HIGHWAY TOLL COLLECTING SYSTEM

[75] Inventors: Mitsuru Kubota, Tokyo; Isao Iwase, Ayase, both of Japan

[73] Assignee: Kabushiki Kaisha Toshiba, Japan

[21] Appl. No.: 616,152

[22] Filed: Jun. 1, 1984

[30] Foreign Application Priority Data

Jun. 1, 1983 [JP] Japan ..... 58-97554

[51] Int. Cl.[4] ..... G07B 15/02

[52] U.S. Cl. ..... 235/384; 235/381

[58] Field of Search ..... 235/381, 384

[56] References Cited

U.S. PATENT DOCUMENTS

| | | | |
|---|---|---|---|
| 3,705,976 | 12/1972 | Platzman | 235/384 |
| 4,303,904 | 12/1981 | Chasek | 235/384 |
| 4,493,103 | 1/1985 | Yamashita et al. | 235/384 |

OTHER PUBLICATIONS

Engineering News-Record, Jun. 30, 1960, "to pay . . toll" pp. 38,39.

*Primary Examiner*—Harold Pitts

*Attorney, Agent, or Firm*—Finnegan, Henderson, Farabow, Garrett & Dunner

[57] ABSTRACT

When a vehicle has reached an entry gate, toll information, such as the type of the vehicle, time and date, etc. are detected and printed on a passage coupon, which is automatically issued at a certain position corresponding to the type of vehicle to be taken by a driver. A highway toll is collected at an exit gate by reading the information on the passage coupon and calculating toll for the vehicle. The information printed on the passage coupon and the information relative to toll calculation are transmitted together with the information concerning the current state of running on the highway to a central control office. A passage coupon issuance unit disposed at the entry gate contains more passage coupons for regular sized vehicles than for other type of vehicles and issues them through passage coupon issuance ports. When a vehicle has entered the highway without a passage coupon being picked up by a driver on the vehicle, the passage coupon which was not picked up is retracted into the passage coupon issuance port.

11 Claims, 4 Drawing Figures

HIGHWAY TOLL COLLECTING SYSTEM

BACKGROUND OF THE INVENTION

1. Field of the Invention

The present invention relates to a highway toll collecting system and more particularly to improvements relating to a highway toll collecting system of the type in which a passage coupon containing information such as entry interchange number and type of car is given to a driver at an entry gate prior to entering the highway, and at an exit gate the toll is calculated and then collected in accordance with the information on the passage coupon.

2. Description of the Prior Art

A conventional highway toll collecting system of the above-mentioned type is disclosed in the official gazette of Japanese Patent Publication No. 12,616/1983. In the conventional system, a passage coupon is prepared as a magnetic card and a passage coupon issuance machine is disposed in a booth (a passage coupon issuance room located at each of entry lanes) at the entry gate. When a person in the booth entry gate visually confirms the vehicle type and the number of extra wheel axles of the vehicle entering the entry gate, he operates a key-board of the passage coupon issuance machine to input these data. The passage coupon issuance machine issues a passage coupon on which prestored data comprising the present interchange number (hereinafter referred to as "entry interchange number"), lane number, booth number, personnel identification number, etc., and newly inputted data comprising vehicle type, date and time when vehicle has passed the entry gate, and serial number of issuance are printed. Further, the data comprising the entry interchange number, vehicle type and the number of extra wheel axles are magnetically recorded on the coupon and transferred to other booths. The prepared passage coupon is then given to a driver by the person in the booth.

A passage coupon confirming machine is disposed at a booth (that is, a toll collecting room) at the exit gate and a person in the exit gate booth receives the passage coupon from the driver when passing the exit gate. That coupon is deposited in the passage coupon confirming machine via a passage coupon insert slit. The passage coupon confirming machine reads the entry interchange number, vehicle type, the number of extra wheel axles, etc., magnetically recorded on the passage coupon and these data are then transmitted to a toll calculating machine. Highway toll calculated by the toll calculating machine is displayed on a toll display device so that the person in the exit gate booth collects from the driver a toll in accordance with the displayed amount on the toll display device.

As described above, in the conventional system personnels are required both at the enty and exit gates. However, since no highway toll is collected at the entry gate it has been desired that manpower should be saved at least in issuing passage coupons at the entry gate.

SUMMARY OF THE INVENTION

Thus, the present invention has been made with the foregoing background in mind and its objects resides in providing an improved highway toll collecting system which assures manpower saving by giving to a driver a passage coupon at the entry without any necessity for manual service by automatically recording any data required for identifying the vehicle passing through the entry gate.

Another object of the invention is to provide an improved highway toll collecting system which assures automatic toll calculation and easy corroboration in accordance with the data on the passage coupon picked up and carried by a driver on the vehicle which has arrived at the exit gate.

Still another object of the invention is to provide an improved highway toll collecting system which enables the collection of all information concerning the state of running on the highway between the entry and exit gates at a central control room so that the number of vehicles to pass through any entry exit gates are properly grasped.

To accomplish the above objects, there is proposed according to the invention a passage coupon issuing machine for automatically issuing passage coupons for use of a toll road in response to vehicle detecting means' detection of vehicles at an entrance to the toll road, the vehicle detecting means being located proximate the entrance to the toll road and providing entry information, including data regarding the time and date at which vehicles arrived at the entrance, and descriptor information about vehicles at the entrance, each of said passage coupons containing identifier information formed from the entry information and the descriptor information, the coupon issuing machine. The machine comprises a plurality of passage coupon issuance ports from which the passage coupons are issued; a first passage coupon issuance mechanism including a first hopper holding a first group of unused passage coupons containing no identifier information, first writing means for writing identifier information onto ones of the first group of passage coupons, and first conveyance means for conveying the ones of said first group of passage coupon containing identifier information into a first set of the plurality of of passage coupon issuance ports; a second passage coupon issuance mechanism including a second hopper holding a second group of unused passage coupons containing no identifier information, second writing means for writing identifier information onto ones of the second group of passage coupons, and second conveyance means for conveying the ones of said passage coupons containing identifier information into a second set of passage coupon issuance ports, the second set of passage coupon issuance ports not being included in said first set of said passage coupon issuance ports; and control means for selectively driving and controlling one of the first or second passage coupon issuance mechanisms based on the identifier information.

According to the invention the passage coupon issuance means includes a plurality of passage coupon issuance ports, the height of which is determined according to the type of vehicles. In view of the fact that so-called regular sized vehicles have most frequent passage in a highway, an arrangement is made such that more blank passage coupons are provided in the passage coupon issuance port for regular sized vehicles When any passage of vehicle is detected by a second vehicle detecting means without an issued passage coupon being taken by a driver, the issued passage coupon is brought back in the passage coupon issuance means until it is recovered in a stocker. Thus, smooth passage throughout the highway is maintained at a high reliability with remarkable manpower saving being achieved. Another advantageous feature of the system is that information concerning the current state of running on the highway is available quickly without difficulty.

Other objects, features and advantages of the invention will become more clearly apparent from reading of the following specification which has been prepared in conjunction with the accompanying drawings.

DESCRIPTION OF THE PREFERRED EMBODIMENT

Now, the present invention will be described in a greater detail hereunder with reference to the accompanying drawings which illustrate a preferred embodiment thereof.

Figure 1:
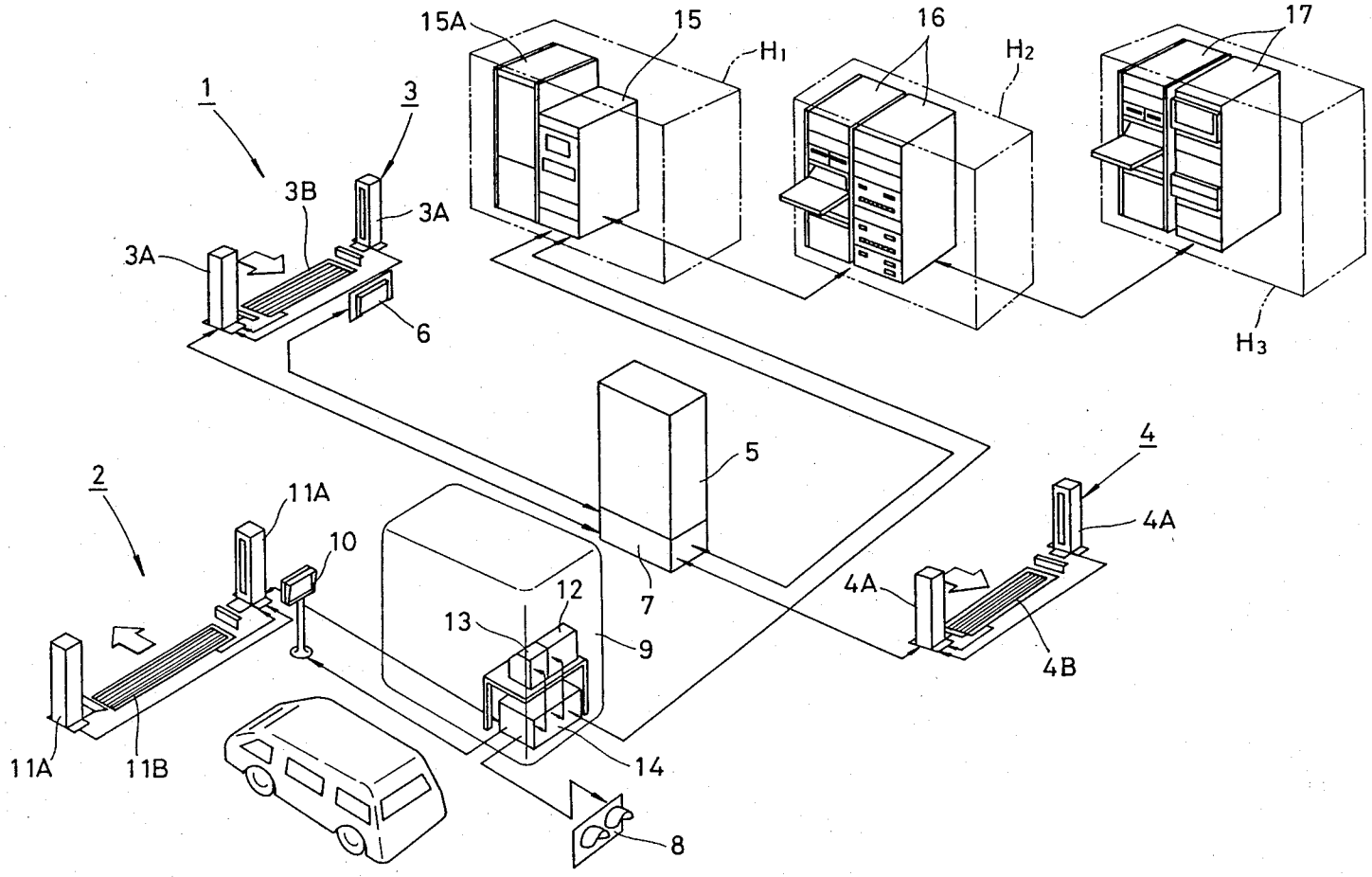
FIG. 1 is a perspective view schematically illustrating a highway toll collecting system in accordance with an embodiment of the invention.

Among the drawings, FIG. 1 is a perspective view schematically illustrating a highway toll collecting system in accordance with an embodiment of the invention. In FIG. 1, reference numeral 1 designates an entry located at a predetermined position on a certain interchange station of a toll road, and reference numeral 2 designates an exit. At the entry 1 is disposed a vehicle detecting apparatus 3 adapted to detect a vehicle which has arrived there. In the illustrated embodiment, the vehicle detecting apparatus 3 is constructed by a pair of first photoelectric detecting columns 3A standing upright at both the sides of a passageway to photoelectrically detect the height of an incoming vehicle, and a first pedestal 3B adapted to output a detection signal when pedestal 3B is depressed by wheels on the vehicle. Pedestal 3B thus detects the number of axles on the vehicle.

As the vehicle moves forward further, it reaches a vehicle passage detecting apparatus 4 for detecting passage of the incoming vehicle. In the illustrated embodiment, the vehicle passage detecting apparatus 4 is constructed by a pair of second photoelectric detecting columns 4A for photoelectrically detecting the height of a vehicle which has passed thereby and a second pedestal 4B for detecting the number of wheel axles on the vehicle.

Between the vehicle detecting apparatus 3 and the vehicle passage detecting apparatus 4 is provided a passage coupon issuance machine 5 which serves to issue a passage coupon at the position where a driver on the vehicle can take it in response to information concerning the incoming vehicle which has reached the vehicle detecting apparatus 3. Machine 5 keeps the coupon as an issued passage coupon when it is detected that the vehicle has moved past the vehicle passage detecting apparatus 4 without a passage coupon. As is apparent from the drawing, a traffic signal 6 is disposed in front of the vehicle detecting apparatus 3 for the purpose of inhibiting a next vehicle from entering the entry 1. Each of the traffic signal 6, the passage coupon issuance machine 5, the vehicle passage detecting apparatus 4 and the vehicle passage detecting apparatus 3 is electrically connected to an entry lane control apparatus 7 adapted to control receipt and transmittance of various data and store therein data relative to the entry lane.

It should be noted that the above-described apparatus and components are provided for each of entry lanes on the interchange station. The apparatus and components for an exit lane will now be described. A traffic signal 8 is disposed at the position opposite to the exit 2 for the purpose of inhibiting the vehicle from leaving there. In the exit area extending between the exit 2 and the traffic signal 8 are arranged a booth (toll receiving room) 9, a toll display 10, a pair of third photoelectrical detecting columns 11A standing upright at both the sides of a passageway for photoelectrically detecting the height of a vehicle which is leaving the exit 2 and a third pedestal 11B adapted to output detection signal when it is depressed by wheels to detect the number of axles on the vehicle which is leaving the exit 2. Further, in the booth 9 are disposed a passage coupon confirming machine 12 for dealing with various works at the exit such as toll calculation or the like on deposit of a passage coupon received from a driver on the vehicle. There is also a receipt issuance machine 13 in booth 9 adapted to issue a receipt by button operation on which a calculated amount of toll is printed. Each of the recipt issuance machine 13, the passage coupon confirming machine 12, the third pedestal 11B, the third photoelectric detecting columns 11A, the toll display 10 and the traffic signal 8 is electrically connected to an exit lane control apparatus 14 adapted to control receipt and transmittance of various data and to store therein data relative to the exit lane. It should be noted that the above-mentioned apparatus and components are provided for each of exit lanes on the interchange station.

The entry lane control apparatus 7 and the exit lane control apparatus 14 are electrically connected to a data processing unit 15 with a data input machine 15A connected thereto. Both of the apparatus 7 and 14 are installed in a toll collecting office $H_1$. The entry information (i.e., entry interchange number, car type, car number, etc.) prerecorded on a passage coupon issued from the passage coupon issuance machine 5, the exit information recorded on the passage coupon by means of the passage coupon confirming machine 12, and the entry information newly recorded on the passage coupon are inputted into the data processing unit 15 to make summation every time when issuance and recovery of a passage coupon are confirmed. The summation is recorded on a strip of recording paper with the aid of a recording machine which is not shown in the drawing. Incidentally, data collected in the data processing unit 15 are transmitted to a data recording apparatus 16 installed in a control room $H_2$ adapted to control a plurality of toll collecting room. Further, data collected in the data processing unit 15 installed in the toll collecting office $H_1$ are transmitted to an electronic computer 17 in the central control office $H_3$ via the data recording apparatus 16.

Now, description will be made in more detail as to the passage coupon issuance machine 5.

Figure 2:
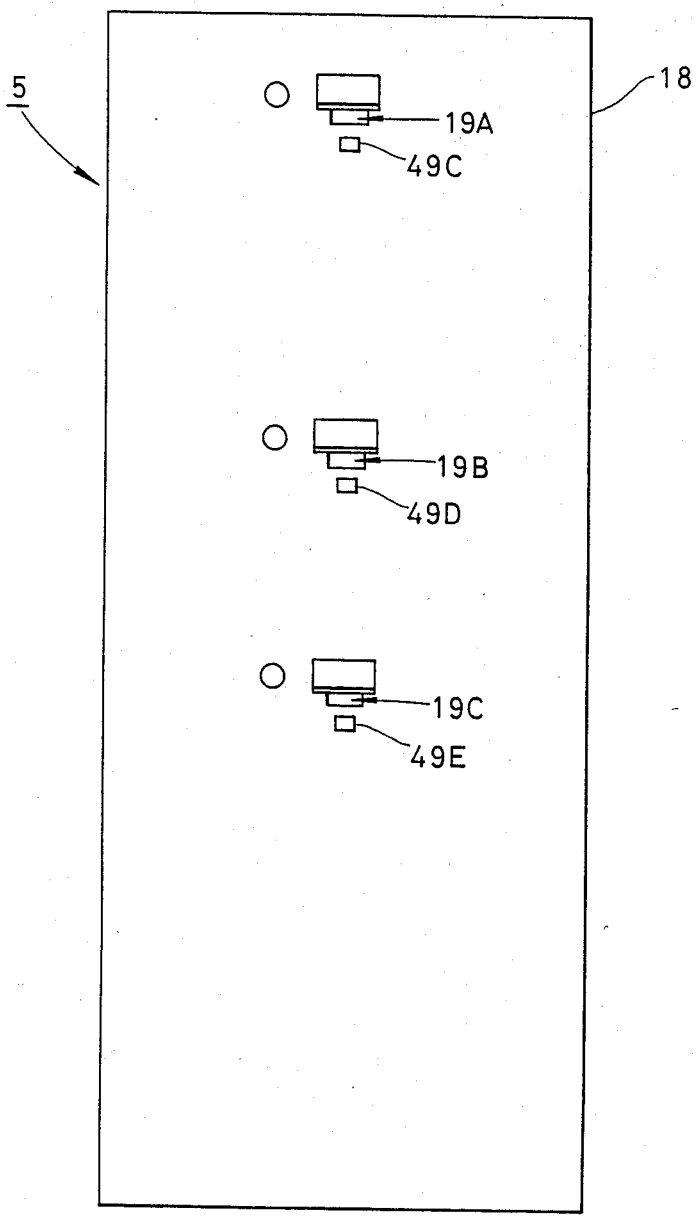
FIG. 2(A) is a front view of a passage coupon issuance machine constituting the highway toll collecting system.
FIG. 2(B) is a vertical sectional view of the passage coupon issuance machine in FIG. 2(A), schematically illustrating how it is constructed.
Figure 2:
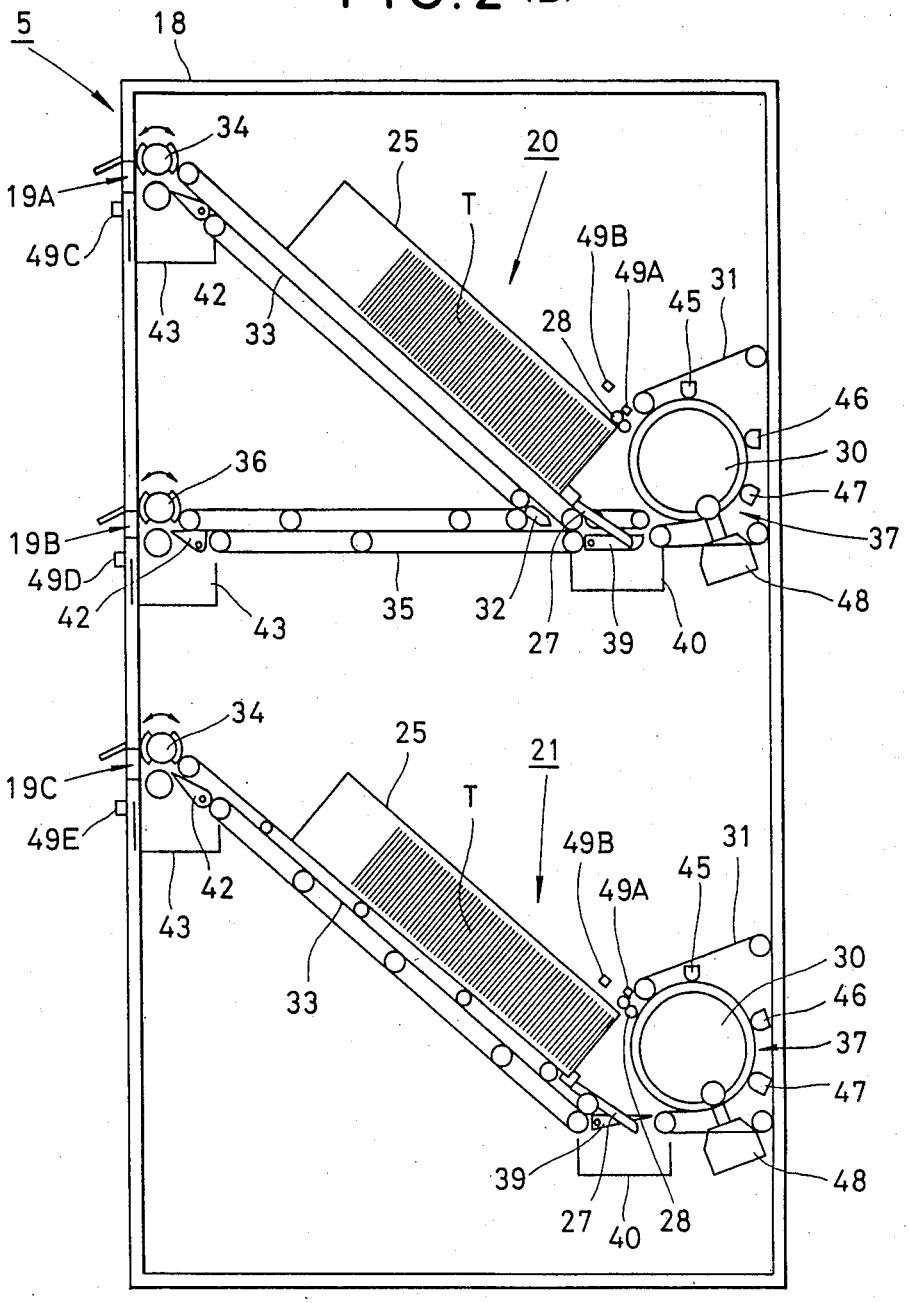

FIG. 2(A) is a front view of an example of the passage coupon issuance machine 5 which includes a housing 18. Specifically, a passage coupon issuance port 19A for specially large sized vehicles and large sized vehicles is disposed at the height of 1,750 mm, a passage coupon issuance port 19B for regular sized vehicles is disposed at the height of 1,200 mm and another passage coupon issuance port 19C for regular sized vehicles is at the height of 830 mm, as measured from the ground surface on the front surface, that is, the surface located opposite to the passageway.

On the other hand, FIG. 2(B) is a vertical sectional view of the passage coupon issuance machine 5 illustrating how the machine 5 is constructed. In the passage coupon issuance machine 5 are provided a passage coupon issuance mechanism 20 for issuing passage coupons through the passage coupon issuance port 19A or 19B as well as a passage coupon issuance mechanism 21 for issuing passage coupons through the passage coupon issuance port 19C.

Description will be first made as to the passage coupon issuance mechanism 20. In the drawing, reference numeral 25 designates a hopper in which a number of passage coupons T are stored in the form of layered structure. Each of passage coupons T is a so-called magnetic passage coupon including a magnetic information stored surface at the one side and a visual information printed surface at the other side. At the lower end part of the hopper 25 are provided a picker 27 and a feed roller 28 both of which serve to take passage coupons T one by one. Further, to convey each of the passage coupons there is a drum 30 rotatably driven by means of a motor which is not shown in the drawing, an endless conveyance belt 31 for displacing a passage coupon while it is brought in frictional contact with the outer surface of the drum 30, a shifting flapper 32 for shifting the direction of displacement of the passage coupon toward the passage coupon issuance port 19A or 19B after conveyance on the endless conveyance belt 31 in cooperation with the drum 30, a pair of conveyance belts 33 for displacing a passage coupon toward the passage coupon issuance port 18A after its direction of displacement is selectively determined by the shifting flapper 32, a reversible discharging roller 34 for projecting passage coupon outwardly of the passage coupon issuance port 19A by a predetermined distance or retracting it as required, after leaving the pair of conveyance belts 33, a pair of conveyance belts 35 for displacing a passage coupon toward the passage coupon issuance port 19B after its direction of displacement is selectively determined by the shifting flapper 32, and a reversible discharging roller 36 for projecting a passage coupon outwardly of the passage coupon issuance port 19B by a predetermined distance or retracting it as required, after leaving the pair of conveyance rollers 35. Thus a passage coupon conveyance mechanism 37 is constituted by the above-described components. To remove incorrect passage coupon, a turnable flapper 39 and a stocker 40 are disposed between the endless conveyance belt 31 and the shifting flapper 32. Further, to recover as an issued passage coupon passage coupons which are retracted into the housing 18, a turnable flapper 42 and a stocker 43 are disposed below each of the discharging rollers 34 and 36 so that the issued passage coupons are brought into the stocker 43 via the flapper 42.

A magnetic reading head 45 is used for scanning the magnetic information stored on the surface of a passage coupon to confirm whether it is a new one or not. A magnetic writing head 46 is used for magnetically writing information including vehicle type, entry interchange number, month, day, time and minute as the magnetic information stored on the surface of passage coupon. There is also a magnetic reading head 47 for confirming the information written by the magnetic writing head 46 and a printing head 48 for printing visual information having the same contents as the magnetic information. The visual information on the printed surface of passage coupon is arranged at on the drum 30 along the track of the conveyance of passage coupons.

In addition, an optical sensor 49A is disposed by the side of the track of conveyance of a passage coupon for the purpose of detecting that a passage coupon has been properly conveyed without clogging. An optical sensor 49B is disposed near the lower end part of the hopper 25 so as to watch a residual amount of blank passage coupons, and optical sensors 49C, 49D and 49E are disposed below the passage coupon issuance ports 19A, 19B and 19C to confirm issuance of passage coupon.

The passage coupon issuance mechanism 21 is constructed to issue passage coupon through the passage coupon issuance port 19C in a manner similar to the first-mentioned passage coupon issuance mechanism 20 with the exclusion of the shifting flapper 32, the pair of conveyance belts 35, the discharging roller 36, the one flapper 42 and the one stocker 43.

Figure 3:
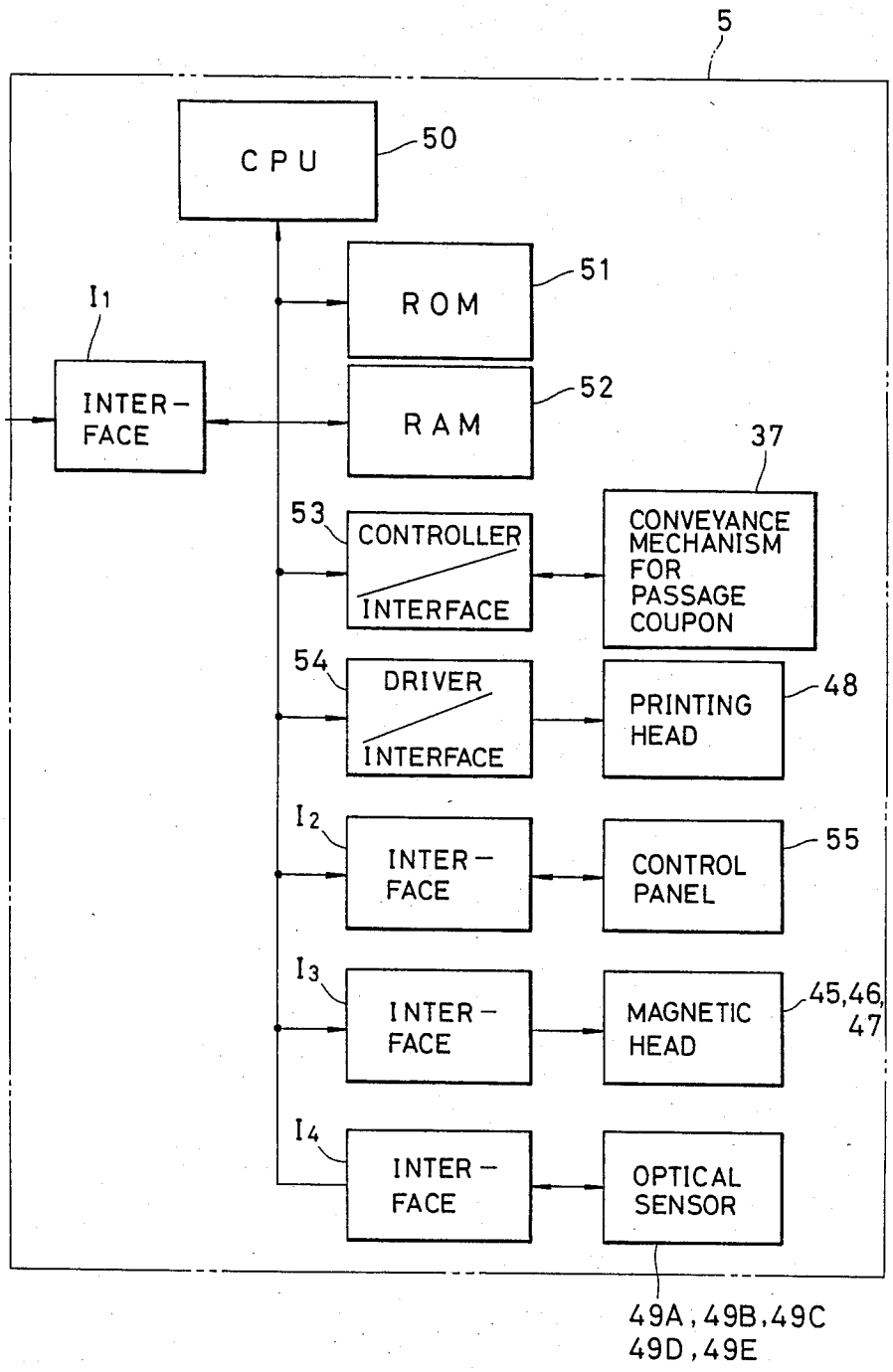
FIG. 3 is a block diagram schematically illustrating the whole structure of the passage coupon issuance machine.

FIG. 3 is a block diagram schematically illustrating the structure of the passage coupon issuance machine as constructed in the above-described manner. The passage coupon issuance machine 5 is connected to the entry lane control apparatus 7 via an interface $I_1$ to which CPU 50, ROM 51 with programs stored therein, RAM 52 for storing processed data which have been processes in the passage coupon issuance machine 5, controller/interface 53 with the passage coupon conveyance mechanism 37 connected thereto, driver/interface 54 with the printing head connected thereto, interface $I_2$ with a control panel 55 connected thereto, interface $I_3$ with the magnetic writing head 46 and both the magnetic reading heads 47 and 45 connected thereto and interface $I_4$ with the optical sensors 49A, 49B, 49C, 49D and 49E connected thereto are connected respectively. Since the passage coupon issuance machine 5 is provided with RAM 52, process data processed in the passage coupon issuance machine 5 are stored in RAM 52 so as to be summed later, even when the data processing apparatus 15 or the electronic computer 17 in FIG. 1 fails to function properly. Therefore the passage coupon issuance machine 5 can be operated independently irrespective of any trouble with the data processing apparatus 15 or the like.

Now, operation of the above-described system will be described.

As a vehicle enters the entry 1 on the interchange station in FIG. 1, the height of the incoming vehicle is detected by means of the pair of first photoelectric detecting columns 3A, and the number of wheel axles of the vehicle is detected by means of the first pedestal 3B whereby the detected information concerning the incoming vehicle are inputted into the entry lane control apparatus 7. Further, the information concerning the incoming vehicle are transmitted to CPU 50 in FIG. 3 via the entry lane control apparatus 7 so as to determine into which vehicle type to classify the incoming vehicle. classified among three types comprising especially large, large, and regular size. Then, CPU 50 selectively determines one of three passage coupon issuance ports with reference to the result of determination concerning the type of vehicle as well as an information as to whether some blank passage coupons remain still in the hopper 25. Namely, when the incoming vehicle is of especially large sized or large sized type, the passage coupon issuance port 19A is selected, whereas when the incoming vehicle is of regular sized type, the passage coupon issuance port 19C is selected, if some blank passage coupons are still held in the hopper 25 in the passage coupon issuance mechanism 21, and otherwise the passage coupon issuance port 19B is selected. Since currently the number of passage coupons issued for regular sized vehicles is much larger than that for especially large sized or large sized vehicles, an arrangement is made such that passage coupon can be issued with the aid of the passage coupon issuance mechanism 20 when no passage coupon is provided in the hopper 25 of the other passage coupon issuance mechanism 21. This makes it possible to issue passage coupons for each type of vehicles while the hopper 25 in the passage coupon issuance mechanism 21 is refilled with passage coupons. As a result, passage coupon issuance services are performed at a high efficiency without interruption. Incidentally, the residual amount of passage coupons is normally watched by means of the optical sensor 49B and therefore the fact that the residual amount of passage coupon is reduced to a predetermined level is transmitted to a person in the nearest booth or to the central control office without delay.

For instance, in case where an incoming vehicle is of large sized type, information concerning it is inputted into the entry lane control apparatus 7 via the interface $I_1$ in FIG. 3. CPU 50 then actuates the passage coupon conveyance mechanism 37 in the passage coupon issuance mechanism 20 under control. Specifically, one of passage coupons T in the hopper 25 is thrusted up by means of the picker 27, it is then displaced by means of the feed roller 28 and it is conveyed further while it is held between the drum 30 and the endless conveyance belt 31. In the course of conveyance of the passage coupon, it is scanned by means of the magnetic reading head 45 so as to detect whether its magnetic information stored surface functions properly or not. Then, a variety of information comprising type of vehicle, entry interchange number, month, day, time and minute are written into the magnetic information stored surface of passage coupon with the aid of the magnetic writing head 46. With reference to the aforesaid information concerning the incoming vehicle, the written information is confirmed by means of the magnetic reading head 47 and thereafter visual information having the same contents as those of the written magnetic information is printed on the visual information printed surface of passage coupon by actuating the printing head 48.

If the processed passage coupon is determined to be incorrect as a result of reading by both the magnetic reading heads 45 and 47, the incorrect coupon recovering flapper 39 is caused to turn downwardly so that it is recovered in the stocker 40. After recovering the incorrect passage coupon, another new coupon is conveyed again and processed in the same manner as described above. On the other hand, when the passage coupon is processed correctly, it is displaced toward the passage coupon issuance port 19A via the shifting flapper 32 so that it is projected outwardly of the passage coupon issuance port 19A after leaving the pair of conveyance belts 33. Thus, a driver on large sized vehicle visually recognizes that a passage coupon is extended from the passage coupon issuance port 19A and he and his his vehicle enter the highway with the passage coupon drawn therefrom.

When the vehicle enters toll highway without a passage coupon picked up from the passage coupon issuance port 19A, that is, when passage of the vehicle is detected by means of the vehicle passage detecting apparatus 4 and issuance of a passage coupon is detected by means of the optical sensor 49C, the issued passage coupon is retracted into the housing 18 by rotating the discharging roller 34 in the anticlockwise direction as seen in FIG. 2(B), and it is then recovered in the stocker 43 with the flapper 42 being turned downwardly. Since a passage coupon which fails to be taken by driver is recovered in the stocker 43 it is assured in the above-described manner, it is assured issuance of another passage coupon is assured to be properly performed for the next incoming vehicle.

It should be noted that the foregoing vehicle which has entered toll highway without passage coupon carried by driver is checked at the outle and toll specified for the length of highway is collected in the same manner as in case where he lost his passage coupon. Hence, there occurs no problem relative to failing to collect highway toll. It should of cource be understood that in case of vehicles other than large sized ones the same steps of toll collection as described above are carried out for the type of vehicles.

When a vehicle reaches the exit, a person in the booth 9 receives a passage coupon carried by the driver on the vehicle, checks it by the passage coupon confirming machine 12 to confirm toll specified for the vehicle, collects the specified toll and then gives him a receipt issued from the receipt issuance machine 13.

Results obtained from handlings at both the entry and exit are transmitted to the data processing apparatus 15, the data recording apparatus 16 and the electronic computer 17 in which they are summed and stored.

It should of course be understood that the above-described embodiment of the invention is merely illustrative and various changes or modifications may be made without departure from the scope of the invention as defined in the appended claims. For instance, the structure of the vehicle detecting apparatus 3 and the vehicle passage detecting apparatus 4 should not be limited to only the illustrated embodiment in which height and the number of wheel axles on vehicle are detected. Alternatively, they may be replaced with another ones in which weight and numerals and/or letters on the number plate are detected. Further, the structure of the passage coupon issuance machine should be not limited only to the illustrated embodiment which includes a first and second passage coupon issuance mechanisms. Alternatively, the two coupon issuance mechanisms may be replaced with a single automatic passage coupon issuance machine which is constituted by properly selected and designed components in an acceptable manner. Incidentally, the passage coupon confirming machine 12 should be preferably constructed as disclosed in official gazettes of Japanese Patent Publication No. 12,616/1983 and Japanese Patent Laid-Open No. 79,591/1982. Alternatively, it may be constructed by a combination of card reading section and processing section (cash register) both of which are built with an individual housing so as to reduce its weight.

What is claimed is:

1. A highway toll system for a highway to assess a toll according to different types of vehicles, said system comprising:

first vehicle detecting means for automatically detecting a vehicle which has reached an entry point of the toll highway prior to entering and for determining vehicle type information for said vehicle by classifying said vehicle as one of a plurality of different types of vehicles;

passage coupon issuance means for issuing a passage coupon in response to the detection of entry of said vehicle and said vehicle type information determined by said first vehicle detecting means, said passage coupon containing toll information which includes a vehicle type code with said vehicle type information, an entry code indentifying the entry point which has been reached by the vehicle, time and date data, representing the time and date respectively, when the vehicle has reached the entry point, said passage coupon issuing means being located on a path for said vehicle from said entry point to said toll highway;

second vehicle detecting means, located on said path between said toll highway and said entry, for detecting the passage of the vehicle past said passage coupon issuance means and for enabling said passage coupon issuance means to issue another passage coupon for a subsequent vehicle;

toll calculating means, disposed at an exit point of the toll highway reached by said vehicle, for receiving the passage coupon issued by said passage coupon issuance means, for reading said toll information from the passage coupon, for calculating a toll for said vehicle based on the vehicle type code and entry code in said toll information read from the passage coupon, and for displaying said toll;

storing means for storing said toll information read by said toll calculating means and said toll calculated by said toll calculating means together with an exit code identifying the exit point; and information processing means for processing highway data based on the toll information and tolls stored in said storing means.

2. A highway toll system as defined in claim 1, wherein said passage coupon issuance means comprises:

a plurality of hoppers for holding blank passage coupons;

a plurality of passage coupons issuance ports each corresponding to a different one of said types of vehicles;

information writing means for writing said toll information on one of said blank passage coupons in said plurality of hoppers;

conveyance means for conveying passage coupons with said toll information written thereon to one of said plurality of passage coupon issuance ports in accordance with the type of said vehicle; and recovering means, disposed proximate said plurality of passage coupon issuance ports, for recovering issued passage coupons which have been conveyed to one of said coupon issuance ports but which have not been removed after said second vehicle detecting means detects passage of said vehicles, said recovering means including means for retracting the conveyed passage coupons when said second vehicle detecting means detects the passage of said vehicle.

3. A highway toll system as defined in claim 2, wherein said first vehicle detecting means includes means for classifying a vehicle as regular-sized or large-sized, wherein said passage coupon issuance ports each comprise a first passage coupon issuance port disposed at a position corresponding to a first predetermined height of regular-sized vehicles;

a second passage coupon issuance port disposed at a position corresponding to a second predetermined height of large-sized vehicles, and a third passage coupon issuance port disposed between said first and second passage coupon issuance ports at a position corresponding to a height between said first and second predetermined heights; wherein said plurality of hoppers comprise a first hopper coupled to said first passage coupon issuance port, and a second hopper coupled to said second and third passage coupon issuance ports; wherein said information writing means comprises first information writing means coupled to said first hopper, and second information writing means coupled to said second hopper; and wherein said conveyance means comprises first conveyance means for conveying to said first passage coupon issuance port passage coupons with information written by said first information writing means, and second conveyance means for selectively conveying to either of said second and third passage coupon issuance ports passage coupons with information written by said second information writing means.

4. A highway toll system as defined in claim 1, wherein said passage coupon issuance means includes watching means for detecting the presence of a predetermined residual amount of blank passage coupons in said passage coupon issuance means; and a traffic signal in communication with said watching means for identifying to said vehicle which has reached the entry point which one of a plurality of lanes the vehicle should enter in accordance with said watching means detection of said predetermined residual amount of blank passage coupons.

5. A passage coupon issuing machine for automatically issuing passage coupons for use of a toll road in response to vehicle detecting means' detection of vehicles at an entrance to the toll road, the vehicle detecting means being located proximate the entrance to the toll road and providing entry information, including data regarding the time and date at which vehicles arrived at the entrance, and descriptor information about vehicles at the entrance, each of said passage coupons containing identifier information formed from the entry information and the descriptor information, the coupon issuing machine comprising:

a plurality of passage coupon issuance ports from which the passage coupons are issued;

a first passage coupon issuance mechanism including a first hopper holding a first group of unused passage coupons containing no identifier information, first writing means for writing identifer information onto ones of said first group of passage coupons, and first conveyance means for conveying said ones of said first group of passage coupon containing identifier information into a first set of said plurality of passage coupon issuance ports;

a second passage coupon issuance mechanism including a second hopper holding a second group of unused passage coupons containing no identifier information, second writing means for writing identifier inf mation onto ones of said second group of passage coupons, and second conveyance means for conveying said ones of said passage coupons containing identifier information into a second set of passage coupon issuance ports, said second set of passage coupon issuance ports not being included in said first set of said passage coupon issuance ports; and control means for selectively driving and controlling one of said first or second passage coupon issuance mechanisms based on said identifier information.

6. A passage coupon issuance machine as set forth in claim 5 wherein the descriptor information includes vehicle size information identifying entering vehicles as either regular-sized, medium-sized, or large-sized, such that regular-sized vehicles are smaller than medium-sized vehicles, and medium-sized vehicles are smaller than large-sized vehicles; and wherein said plurality of passage coupon issuance ports comprises a first issuance port disposed at a first position corresponding to the height of regular-sized vehicles, a second issuance port disposed at a second position, higher than said first position, and corresponding to the height of medium-sized vehicles, and a third issuance port disposed at a third position, higher than said second position, and corresponding to the height of large-sized vehicles; and wherein said first conveyance means includes means for conveying passage coupons only to said first issuance port; and wherein said second conveyance means includes means for conveying passage coupons selectively into either said second issuance port or said said third issuance port according to said vehicle size information.

7. A passage coupon issuance machine as set forth in claim 6, wherein said first passage coupon issuance mechanism further includes first residual amount detecting means for detecting a first minimum amount of said first group of unused passage coupons in said first hopper, and first abnormality detecting means for detecting malfunctions in the conveyance of said first group of passage coupons;

wherein said second passage coupon issuance mechanism further includes second residual amount detecting means for detecting a second minimum amount of said second group of unused passage coupons in said second hopper, and second abnormality detecting means for detecting malfunctions in the conveyance of said second group of passage coupons; and wherein said control means includes means for driving one of said first or second passage coupon issuance mechanisms when, in the other one of said first or second passage coupon issuance mechanisms, the corresponding one of said first or second residual amount detecting means detects fewer than said first or second minimum amounts of passage coupons or when the corresponding one of said first or second abnormality detecting means detects a malfunction in conveyance.

8. A passage coupon issuance machine as set forth in claim 7 wherein said second conveyance means includes means for responding to either said first residual amount detecting means' detection of fewer than said first minimum amount of passage coupons or said first abnormality detecting means' detection of a malfunction in conveyance by conveying passage coupons into said second issuance port when said vehicle size information identifies an entering vehicle as regular-sized or medium-sized, and by conveying passage coupons into said third issuance port when said vehicle size information identifies said entering vehicle as large-sized.

9. A passage coupon issuing machine for automatically issuing passage coupons for use of a toll road in response to vehicle detecting means' detection of entry of vehicles at an entrance to the toll road, the vehicle detecting means being located proximate the entrance to the toll road and providing entry information, including data regarding the time and date at which vehicles arrived at the entrance, and descriptor information, including size information indicating whether each vehicle is regular-sized, medium-sized, or large-sized such that large-sized vehicles are larger than said medium-sized vehicles and mediumsized vehicles are larger than said regular-sized vehicles, each of said passage coupons containing identifier information formed from the entry and descriptor information, said passage coupon issuing machine comprising:

a first passage coupon issuance port from which passage coupons are issued, said first passage coupon issuance port being disposed at a first position corresponding to the height of regular-sized vehicles;

a second passage coupon issuance port from which passage coupons are issued, said second passage coupon issuance port being disposed at a second position, higher than said first position, corresponding to the height of medium-sized vehicles;

a third passage coupon issuance port from which passage coupons are issued, said third passage coupon issuance port being disposed at a third position, higher than said second position, corresponding to the height of large-sized vehicles;

a first passage coupon issuance mechanism including a first hopper holding a first group of unused passage coupons containing no identifier information, first writing means for writing identifier information onto ones said said first group of unused passage coupons, and first conveyance means for conveying said ones of said first group of passage coupons containing identifier information into a first set of said first passage coupon issuance ports;

a second passage coupon issuance mechanism including a second hopper holding a second group of unused passage coupons containing no identifier information, second writing means for writing identifier information onto ones of said second group of unused passage coupons, and second conveyance means for selectively conveying said ones of said second group of passage coupons containing identifier information into either said second or said third passage coupon issuance ports; and control means for driving said first passage coupon issuance mechanism when the size information identifies one of said vehicles as regular-sized, for driving said second passage coupon issuance mechanism and for causing said second conveyance means to convey passage coupons to said second passage coupon issuance port when the size information identifies one of said vehicles as medium-sized, and for driving said second passage coupon issuance mechanism and for causing the second conveyance means to convey passage coupons into said third passage coupon issuance port when the size information identifies one of said vehicles as large-sized.

10. A passage coupon issuance machine as set forth claim 9 wherein said first passage coupon issuance mechanism further includes first residual amount detecting means for detecting a first minimum amount of said first group of unused passage coupons in said first hopper, and first abnormality detecting means for detecting malfunctions in the conveyance of said first group of passage coupons;

wherein said second passage coupon issuance mechanism further includes second residual amount detecting means for detecting a second minimum amount of said second group of unused passage coupons in said second hopper, and second abnormality detecting means for detecting malfunctions in the conveyance of said second group of passage coupons; and wherein said control means includes means for driving one of said first or second coupons issuance mechanisms when, in the other one of said first or second coupon issuance mechanisms, the corresponding one of said first or second residual amount detecting means detects fewer than said first or second minimum amount of passage coupons, or when the corresponding one of siad first or second one of said detecting means detects a malfunction in conveyance.

11. A passage coupon issuance machine as set forth in claim 10 wherein said second conveyance means includes means for responding either to said first residual amount detecting means' detection of fewer than said minimum amount of coupons or said first abnormality detecting means' detection of a malfunction in conveyance by conveying passage coupons into said second issuance port when the vehicle size information identifies an entering vehicle as regular-sized or medium-sized, and by conveying passage coupons into said third issuance port when the descriptor information identifies an entering vehicle as large-sized.

* * * * *